US007420447B2

(12) United States Patent
Ruan et al.

(10) Patent No.: US 7,420,447 B2
(45) Date of Patent: Sep. 2, 2008

(54) LATCHING MICRO-MAGNETIC SWITCH WITH IMPROVED THERMAL RELIABILITY

(75) Inventors: Meichun Ruan, Tempe, AZ (US); Jun Shen, Phoenix, AZ (US); Gordon Tam, Gilbert, AZ (US)

(73) Assignee: Schneider Electric Industries SAS (FR)

( * ) Notice: Subject to any disclaimer, the term of this patent is extended or adjusted under 35 U.S.C. 154(b) by 82 days.

(21) Appl. No.: 11/151,663

(22) Filed: Jun. 14, 2005

(65) Prior Publication Data

US 2006/0114084 A1 Jun. 1, 2006

Related U.S. Application Data

(63) Continuation of application No. 10/390,164, filed on Mar. 18, 2003, now abandoned.

(60) Provisional application No. 60/364,617, filed on Mar. 18, 2002.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | |
|---|---|---|---|
| 4,065,677 | A | 12/1977 | Micheron et al. |
| 4,461,968 | A | 7/1984 | Kolm et al. |
| 4,496,211 | A | 1/1985 | Daniel |
| 4,570,139 | A | 2/1986 | Kroll |
| 5,016,978 | A | 5/1991 | Fargette et al. |
| 5,048,912 | A | 9/1991 | Kunikane et al. |
| 5,398,011 | A | 3/1995 | Kimura et al. |
| 5,472,539 | A | 12/1995 | Saia et al. |
| 5,475,353 | A | 12/1995 | Roshen et al. |
| 5,557,132 | A | 9/1996 | Takahashi |
| 5,578,976 | A | 11/1996 | Yao |
| 5,629,918 | A | 5/1997 | Ho et al. |
| 5,638,946 | A | 6/1997 | Zavracky |

(Continued)

FOREIGN PATENT DOCUMENTS

FR 2572546 A1 5/1986

(Continued)

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

(Continued)

*Primary Examiner*—Elvin Enad
*Assistant Examiner*—Bernard Rojas
(74) *Attorney, Agent, or Firm*—Sterne, Kessler, Goldstein & Fox PLLC.

(57) ABSTRACT

A micro-magnetic switch includes a permanent magnet and a supporting device having contacts coupled thereto and an embedded coil. The supporting device can be positioned proximate to the magnet. The switch also includes a cantilever coupled at a central point to the supporting device. The cantilever has a conducting material coupled proximate an end and on a side of the cantilever facing the supporting device and having a soft magnetic material coupled thereto. During thermal cycling the cantilever can freely expand based on being coupled at a central point to the supporting device, which substantially reduces coefficient of thermal expansion differences between the cantilever and the supporting device.

7 Claims, 15 Drawing Sheets

TOP VIEW

SIDE VIEW (A-A')

U.S. PATENT DOCUMENTS

| | | | | |
|---|---|---|---|---|
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillen et al. | |
| 6,307,452 | B1 | 10/2001 | Sun | |
| 6,469,602 | B2 | 10/2002 | Ruan et al. | |
| 6,469,603 | B1 * | 10/2002 | Ruan et al. | 335/78 |
| 6,633,158 | B1 | 10/2003 | Shen et al. | |
| 6,639,493 | B2 | 10/2003 | Shen et al. | |
| 6,750,745 | B1 | 6/2004 | Wei et al. | |
| 2003/0222740 | A1 | 12/2003 | Ruan et al. | |
| 2004/0036132 | A1 | 2/2004 | de los Santos | |

FOREIGN PATENT DOCUMENTS

| | | |
|---|---|---|
| JP | 54-161952 | 12/1979 |
| JP | 4-275519 | 10/1992 |
| JP | 6-251684 | 9/1994 |
| WO | WO 97/39468 | 10/1997 |
| WO | WO 98/34269 | 8/1998 |
| WO | WO 9927548 | 6/1999 |
| WO | WO 01/57899 | 8/2001 |
| WO | WO 01/84211 | 11/2001 |

OTHER PUBLICATIONS

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htm, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K.R. Farmer, W.N. Carr,"A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, 1998, Jun. 1998, pp. 304-307.

John A. Wright, Yu-Chong Tai, and Shih-Chia Chang, "A Large-Force, Fully-Integrated MEMS Magnetic Actuator", Transducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

* cited by examiner

TOP VIEW

SIDE VIEW

TOP VIEW

SIDE VIEW

SIDE VIEW

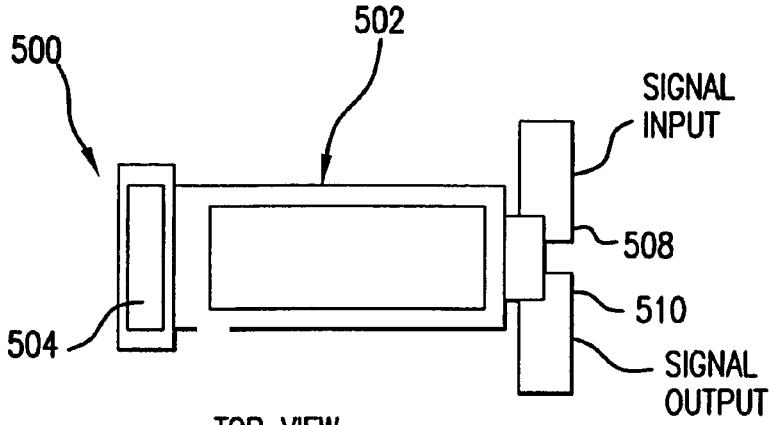
TOP VIEW
FIG.5a
SIDE VIEW
FIG.5b
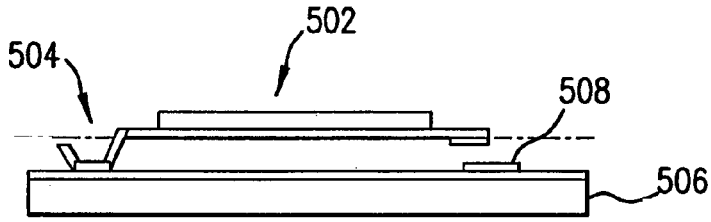
SIDE VIEW
FIG.5c
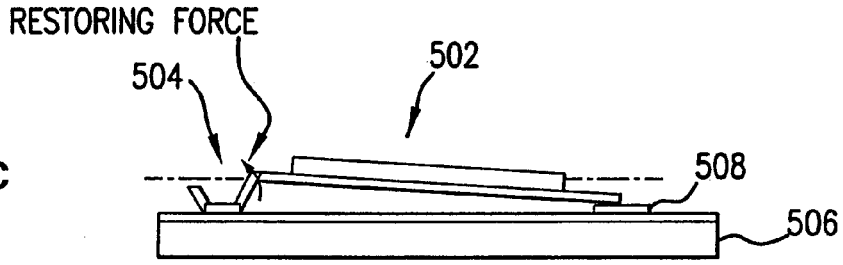
SIDE VIEW
FIG.5d
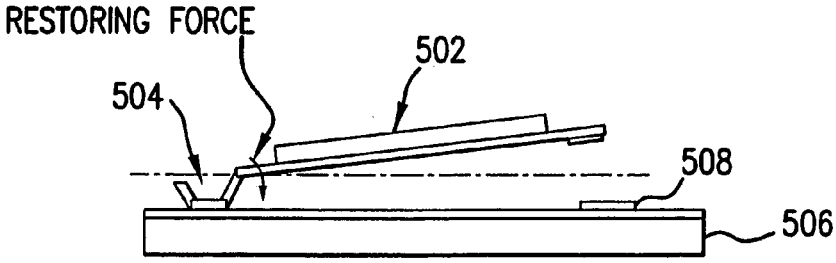

TOP VIEW

SIDE VIEW (A-A')

SIDE VIEW (B-B')

TOP VIEW

SIDE VIEW (A-A')

SIDE VIEW (B-B')

TOP VIEW

SIDE VIEW (A-A')

SIDE VIEW (B-B')

TOP VIEW

SIDE VIEW (A-A')

SIDE VIEW (B-B')

TOP VIEW

SIDE VIEW (A-A')

SIDE VIEW (B-B')

(A-A')

(B-B')

(A-A')

(B-B')

LATCHING MICRO-MAGNETIC SWITCH WITH IMPROVED THERMAL RELIABILITY

CROSS REFERENCE TO RELATED APPLICATIONS

This application is a continuation of U.S. application Ser. No. 10/390,164, filed Mar. 18, 2003 (now abandoned), which claims benefit under 35 U.S.C. § 119(e) to U.S. Provisional Patent App. No. 60/364,617, filed Mar. 18, 2002, which are incorporated by reference herein in their entireties.

BACKGROUND OF THE INVENTION

1. Field of the Invention

The present invention relates to electronic switches. More specifically, the present invention relates to latching micro-magnetic switches with structures having improved thermal and contact reliability.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e. the quiescent state) and they are not latching (i.e. they do not retain a constant output as power is removed from the relay). Moreover, the spring required by conventional micro-magnetic relays may degrade or break over time.

Another micro-magnetic relay includes a permanent magnet and an electromagnet for generating a magnetic field that intermittently opposes the field generated by the permanent magnet. This relay must consume power in the electromagnet to maintain at least one of the output states. Moreover, the power required to generate the opposing field would be significant, thus making the relay less desirable for use in space, portable electronics, and other applications that demand low power consumption.

A bi-stable, latching switch that does not require power to hold the states is therefore desired. Such a switch should also be reliable, simple in design, low-cost and easy to manufacture, and should be useful in optical and/or electrical environments.

BRIEF SUMMARY OF THE INVENTION

The latching micro-magnetic switch of the present invention can be used in a plethora of products including household and industrial appliances, consumer electronics, military hardware, medical devices and vehicles of all types, just to name a few broad categories of goods. The latching micro-magnetic switch of the present invention has the advantages of compactness, simplicity of fabrication, and has good performance at high frequencies.

Embodiments of the present invention provide a micro-magnetic switch including a permanent magnet and a supporting device having contacts coupled thereto and an embedded coil. The supporting device can be positioned proximate to the magnet. The switch also includes a cantilever coupled at a central point to the supporting device. The cantilever has a conducting material coupled proximate an end and on a side of the cantilever facing the supporting device and having a soft magnetic material coupled thereto. During thermal cycling the cantilever can freely expand based on being coupled at a central point to the supporting device, which substantially reduces coefficient of thermal expansion differences between the cantilever and the supporting device.

In one aspect of the present invention the switch also includes a metal layer coupled to the supporting device and an insulating layer formed on the metal layer, wherein the central point of the cantilever is coupled to the insulating layer.

In on aspect of the present invention the switch also includes a high permeability layer formed between the metal layer and the supporting device.

In one aspect of the present invention the contacts can comprise first and second spaced input contacts and first and second spaced output contacts, such that the conducting material interacts with both contacts substantially simultaneously, which balances an external actuation force.

In one aspect of the present invention the cantilever can include a spring between the central point and first and second end points.

In one aspect of the present invention the cantilever can include two springs between the central point and each of first and second end points.

In one aspect of the present invention the cantilever can be coupled via first and second spaced areas of the central point to the supporting structure.

BRIEF DESCRIPTION OF THE DRAWINGS/FIGURES

The above and other features and advantages of the present invention are hereinafter described in the following detailed description of illustrative embodiments to be read in conjunction with the accompanying drawing figures, wherein like reference numerals are used to identify the same or similar parts in the similar views.

FIGS. 4-14 illustrate various embodiments according to the present invention.

DETAILED DESCRIPTION OF THE INVENTION

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems)

may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application. Moreover, it should be understood that the spatial descriptions (e.g. "above", "below", "up", "down", etc.) made herein are for purposes of illustration only, and that practical latching relays may be spatially arranged in any orientation or manner. Arrays of these relays can also be formed by connecting them in appropriate ways and with appropriate devices.

Principle of Operation

Figure 1A:
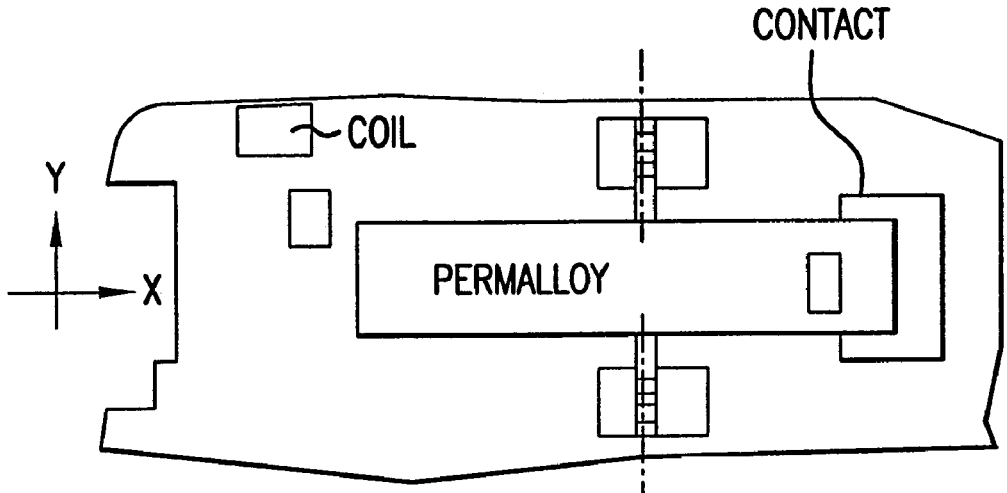
FIGS. 1A and 1B are side and top views, respectively, of an exemplary embodiment of a latching micro-magnetic switch.
Figure 1B:
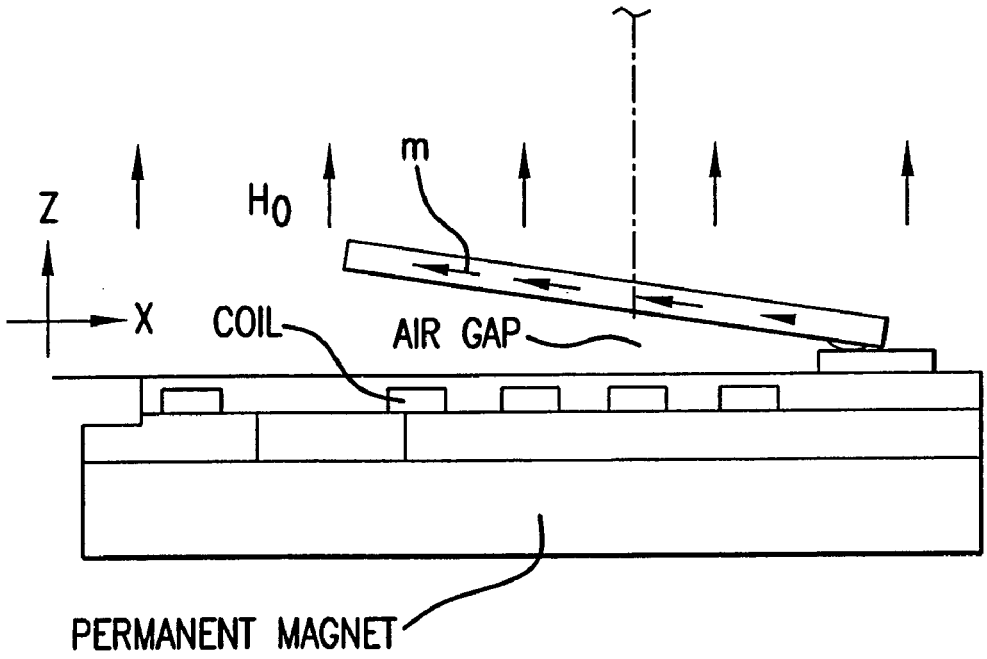

The basic structure of the microswitch is illustrated in FIGS. 1A and 1B, which include a top view and a cross sectional view, respectively. The device (i.e., switch) comprises a cantilever 102, a planar coil 104, a permanent magnet 106, and plural electrical contacts 108/110. The cantilever 102 is a multi-layer composite consisting, for example, of a soft magnetic material (e.g., NiFe permalloy) on its topside and a highly conductive material, such as Au, on the bottom surface. The cantilever 102 can comprise additional layers, and can have various shapes. The coil 104 is formed in a insulative layer 112, on a substrate 114.

Figure 2A:
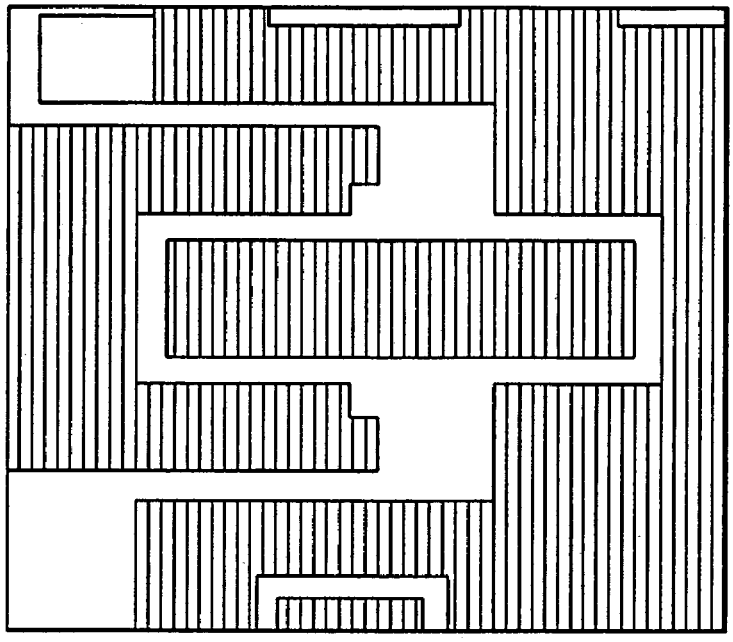
FIG. 2 illustrates a hinged-type cantilever and a one-end-fixed cantilever, respectively.
Figure 2B:
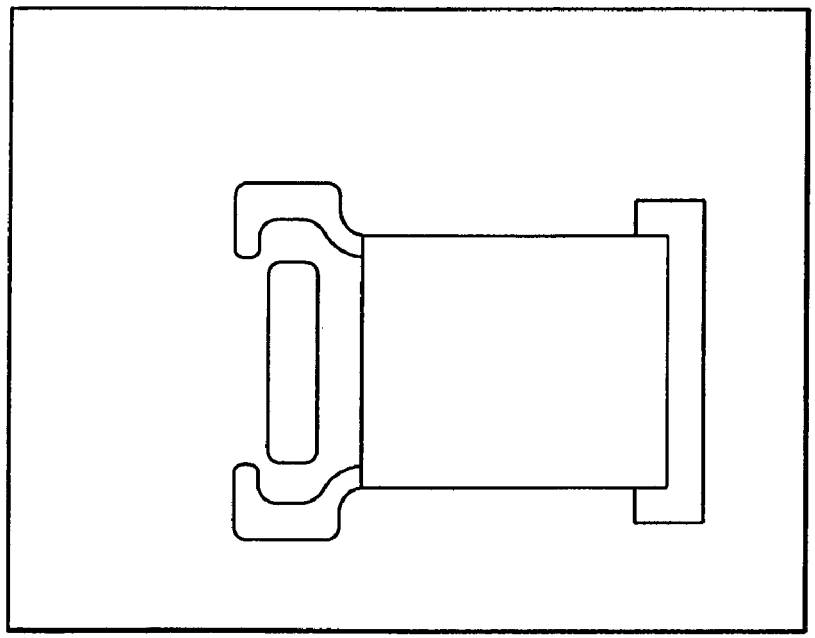

In one configuration, the cantilever 102 is supported by lateral torsion flexures 116 (see FIGS. 1 and 2, for example). The flexures 116 can be electrically conductive and form part of the conduction path when the switch is closed. According to another design configuration, a more conventional structure comprises the cantilever fixed at one end while the other end remains free to deflect. The contact end (e.g., the right side of the cantilever) can be deflected up or down by applying a temporary current through the coil. When it is in the "down" position, the cantilever makes electrical contact with the bottom conductor, and the switch is "on" (also called the "closed" state). When the contact end is "up", the switch is "off" (also called the "open" state). The permanent magnet holds the cantilever in either the "up" or the "down" position after switching, making the device a latching relay. A current is passed through the coil (e.g., the coil is energized) only during a brief period of time to transistion between the two states.

(i) Method to Produce Bi-Stability

Figure 3:
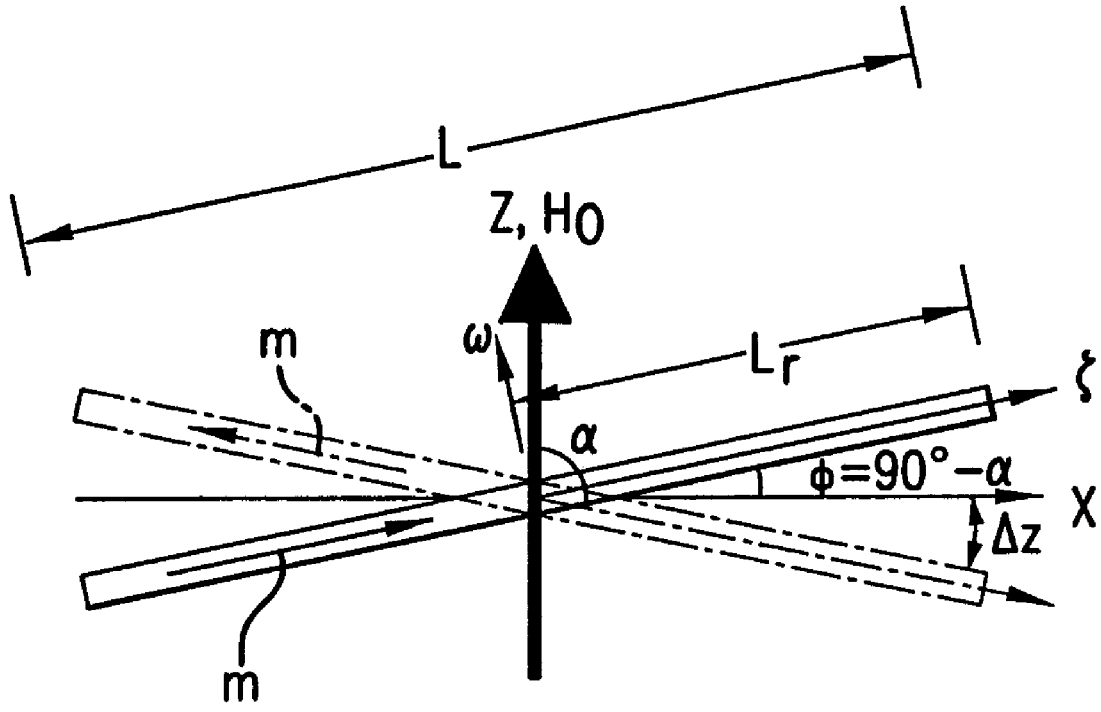
FIG. 3 illustrates a cantilever body having a magnetic moment m in a magnetic field $H_O$.

The by which bi-stability is produced is illustrated with reference to FIG. 3. When the length L of a permalloy cantilever 102 is much larger than its thickness t and width (w, not shown), the direction along its long axis L becomes the preferred direction for magnetization (also called the "easy axis"). When such a cantilever is placed in a uniform permanent magnetic field, a torque is exerted on the cantilever. The torque can be either clockwise or counterclockwise, depending on the initial orientation of the cantilever with respect to the magnetic field. When the angle (*) between the cantilever axis (*) and the external field ($H_0$) is smaller than 90°, the torque is counterclockwise; and when * is larger than 90°, the torque is clockwise. The bi-directional torque arises because of the bi-directional magnetization (by $H_0$) of the cantilever (from left to right when *<90°, and from right to left when *>90°). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the *−component (along the cantilever, see FIG. 3) of this field that is used to reorient the magnetization in the cantilever. The direction of the coil current determines whether a positive or a negative *−field component is generated. Plural coils can be used. After switching, the permanent magnetic field holds the cantilever in this state until the next switching event is encountered. Since the *−component of the coil-generated field (Hcoil−*) only needs to be momentarily larger than the *−component ($H_0$*~$H_0$ cos(*)=$H_0$ sin(*), *=90°−*) of the permanent magnetic field and * is typically very small (e.g., **5°), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bistable states are possible when other forces can balance die torque. A coil can generate a momentary magnetic field to switch the orientation of magnetization along the cantilever and thus switch the cantilever between the two states.

The above-described micro-magnetic latching switch is further described in U.S. Pat. No. 6,469,602 (titled Electronically Switching Latching Micro-magnetic Relay And Method of Operating Same). This patent provides a thorough background on micro-magnetic latching switches and is incorporated herein by reference in its entirety.

Although latching micro-magnetic switches are appropriate for a wide range of signal switching applications, reliability due to thermal cycling is an issue.

Figure 4A:
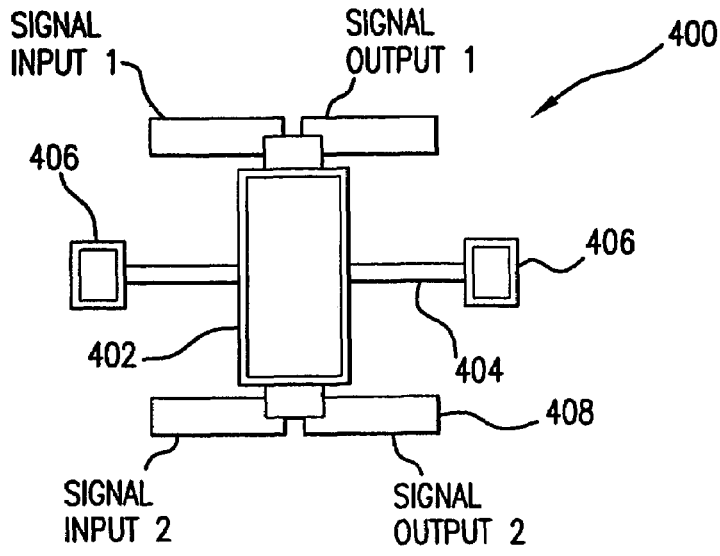
Figure 4B:
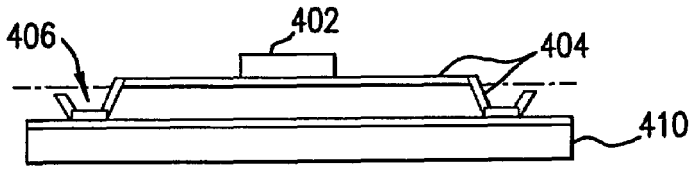
Figure 4C:
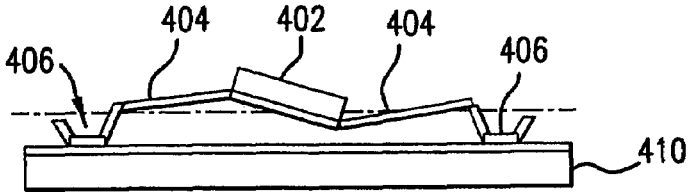

FIGS. 4A-C illustrate a known micro device structure 400 having a movable cantilever 402 supported by two torsion flexures 404, which are fixed by fixing devices (e.g., anchors) 406. Cantilever 402 interacts with contacts 408 on substrate 410. The cantilever 402 can be flat (see FIG. 4B) as fabricated. However, due to the difference between coefficients of thermal expansion (CTE) of the cantilever 402 and a substrate 410, the substrate 410 and a cantilever assembly, which includes cantilever 402 and the torsion flexures 404, can expand or shrink differently when temperature changes. Because the cantilever assembly is fixed by anchors 406 at the two ends, the cantilever assembly can deform and even buckle (see FIG. 4C) when the fabricated device 400 goes through temperature cycling, which can make the device 400 fail or malfunction. To pass a signal from the input 1 to the output 1, the cantilever 402 needs to touch both the input 1 bottom pad 408 and the output 1 pad 408. Therefore, two physical contacts of input 1 versus cantilever and cantilever versus output 1 are made to achieve the electrical path.

The device 500 of FIG. 5 also has a movable cantilever 502 supported by a fixed device 502 coupled to a substrate 506 on one end. In this design, the cantilever 502 can freely expand on one end and thus will not have the problem encountered by the design in FIG. 4. However, this design is not ideal in the operation. When the cantilever 502 is pulled down by a suitable actuation mechanism (e.g., magnetic, electrostatic, thermal, etc.), its open end touches down on the bottom contact 508. In order to have maximum contact force, it is preferred to have a minimum mechanical restoring force (dashed arrows). When the cantilever 502 is pushed up by an opposite force (e.g., magnetic, electrostatic, thermal, etc.), it has to rely on the mechanical restoring force in the cantilever 502 to counter balance the external force to stay in the up position. So the requirement on the strength of the restoring forces in the "down" and "up" states can be contradictory, and the performance of the micro device 500 is compromised. In this design, to pass a signal from the input to the output, the cantilever 502 needs to touch both the input bottom pad 508 and the output pad 510. Therefore, two physical contacts of input versus cantilever and cantilever versus output are made to achieve the electrical path.

Figure 6A:
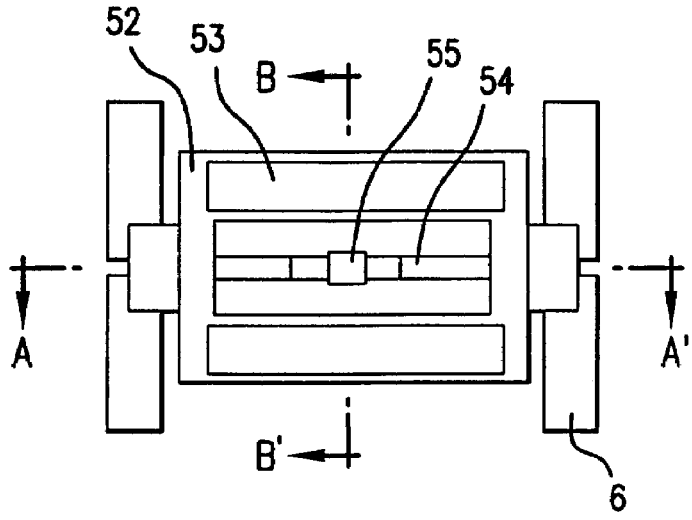
Figure 6B:
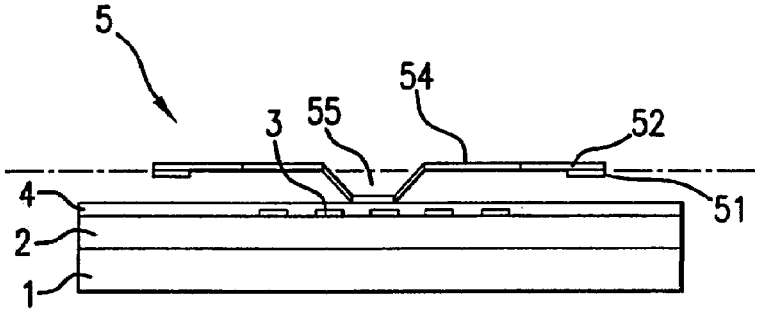
Figure 6C:
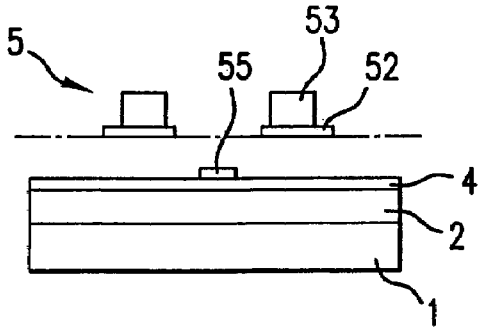

FIG. 6 illustrates an embodiment of the present invention. The device comprises bottom conductors (6) fabricated on a suitable substrate (2) covered with an optional dielectric material (4), an embedded coil (3), a cantilever (5) supported by springs (54) with a single stage (55) on the substrate. The cantilever (5) has a bottom conducting layer (51), a thin structural material (52), and thick soft magnetic materials (53). A permanent magnet (3) provides a static magnetic field approximately perpendicular to the longitudinal axis of the cantilever. The cantilever can rotate about the torsion spring under external influences (e.g., magnetic fields). Since this inventive design has only one fixed stage on the substrate, the problem due to the CTE difference between the cantilever and the substrate is at least partially solved because the cantilever can freely expand on its free end during the thermal cycling. Also, the cantilever has two contact ends to counter balance the external actuation force and thus does not rely on the mechanical restoring force in the torsion springs (54) to counter balance the external actuation force. Thus, the torsion spring can be designed to minimize the restoring force and maximize the contact force.

Figure 7A:
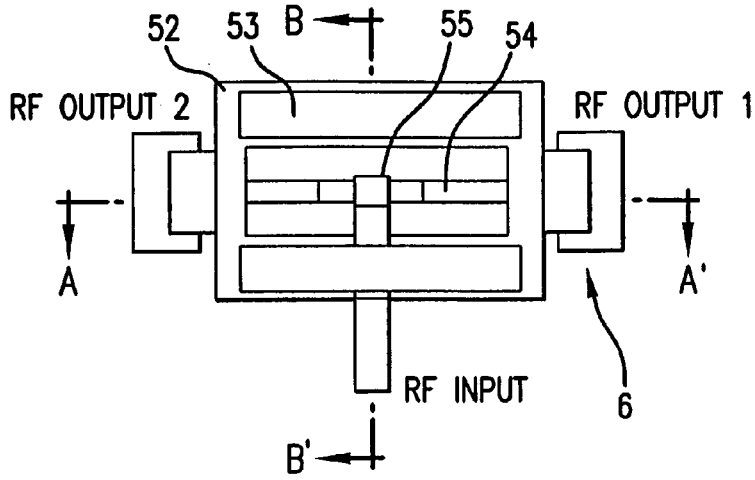
Figure 7B:
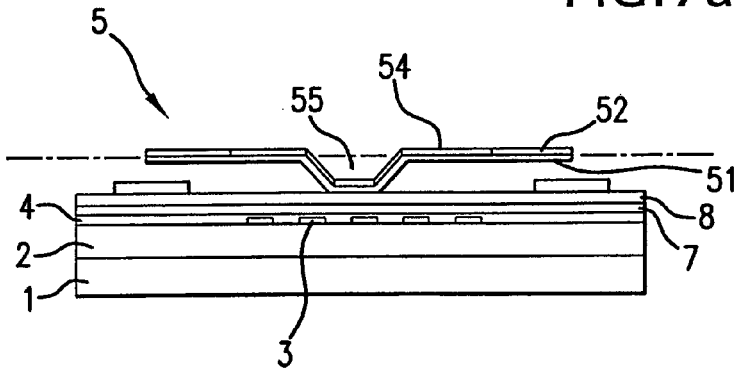
Figure 7C:
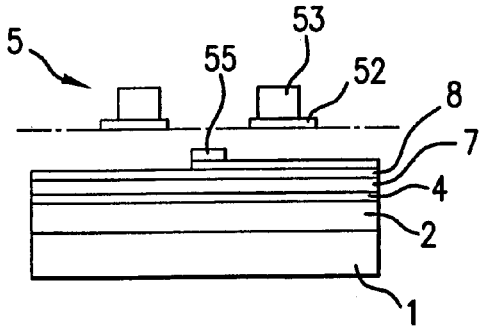

FIG. 7 illustrates a further embodiment of the present invention, which includes a metal layer (RF ground plane [) above the coil and below the cantilever and the RF signal line. The effect of the ground plane is to shield the RF signal from the driving coil signals. The device comprises bottom conductors (6) fabricated on a suitable insulator (8) coated on a metal layer (7), a dielectric layer (4), an embedded coil (3), a cantilever (5) supported by springs (54) with a single stage (55) on the substrate (2). The cantilever (5) has a bottom conducting layer (51), a thin structural material (52), and thick soft magnetic materials (53). A permanent magnet (1) provides a static magnetic field approximately perpendicular to the longitudinal axis of the cantilever. The cantilever can rotate about the torsion spring under external influences (e.g., magnetic fields). Since this inventive design has only one contact on each side, it reduces the requirement of the prior art from making two contacts at the same time down to making just one contact. Therefore, it improves the contact reliability. Also metal layer (7), which serves as a ground plane, shields the influence of the coil to the signal in the RF application. The signal travels from the input metal trace (not shown in the figure) to the stage (55), through spring (54), conductor (51) to the output pad (6). Conductor (51) can also be conformably extended or fabricated under the spring (54) and under the stage (55).

Figure 8A:
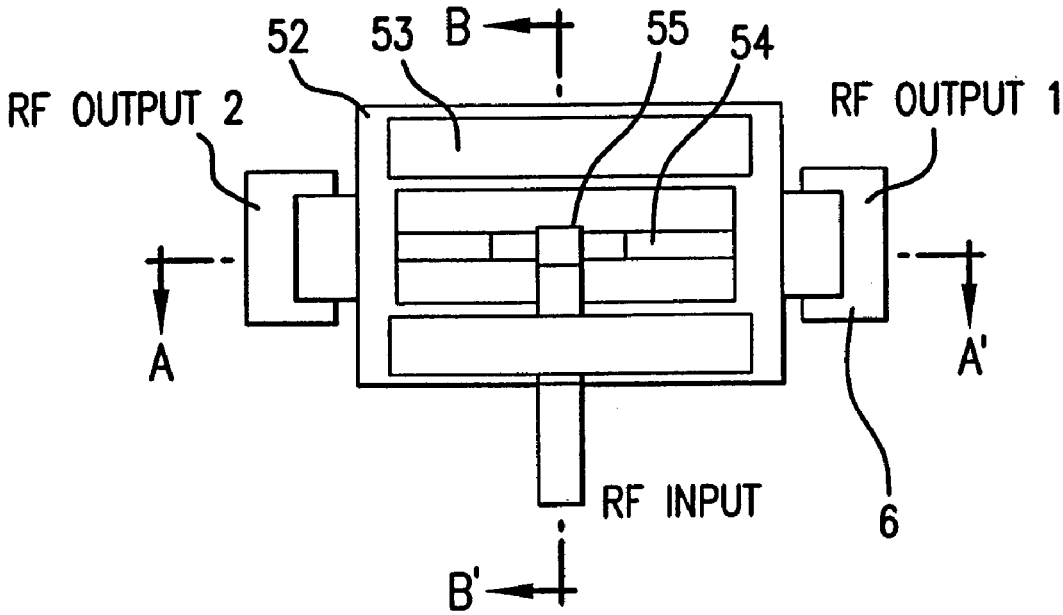
Figure 8B:
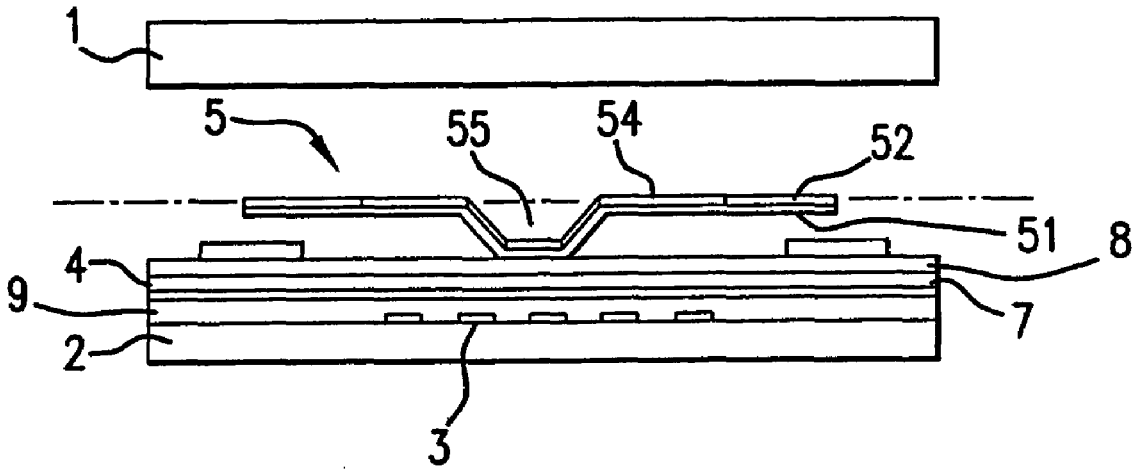
Figure 8C:
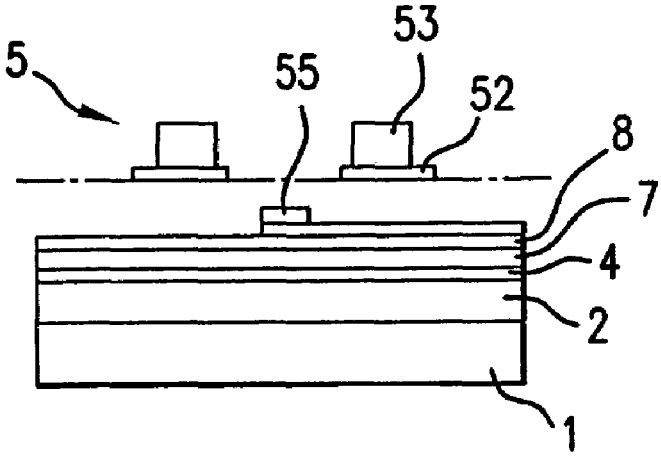

FIG. 8 illustrates a further embodiment of the present invention. The device of FIG. 8 comprises bottom conductors (6) fabricated on a suitable insulator (8) coated on a metal layer (7), a dielectric layer (4), an embedded coil (3), a high-permeability material (e.g., permalloy) layer (9), a cantilever (5) supported by springs (54) with a single stage (55) on the substrate (2). The cantilever (5) has a bottom conducting layer (51), a thin structural material (52), and thick soft magnetic materials (53). A permanent magnet (1) provides a static magnetic field approximately perpendicular to the longitudinal axis of the cantilever. The high-permeability material layer (9) forms a magnetic dipole with the permanent magnet (1). The cantilever can rotate about the torsion spring under external influences (e.g., magnetic fields). Since this inventive design has only one contact on each side, it reduces the requirement of the prior art from making two contacts at the same time down to making just one contact. Therefore, it improves the contact reliability. Also metal layer (7), which serves as a ground plane, shields the influence of the coil to the signal in the RF application. The signal travels from the input metal trace (not shown in the figure) to the stage (55), through spring (54), conductor (51) to the output pad (6). Conductor (51) can also be conformably extended or fabricated under the spring (54) and under the stage (55).

Figure 9A:
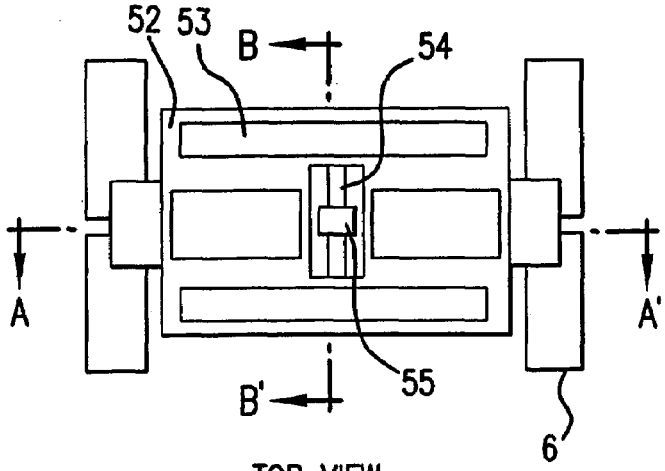
Figure 9B:
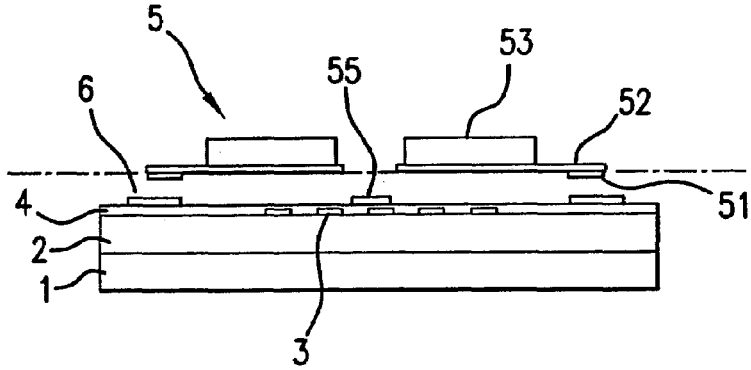
Figure 9C:
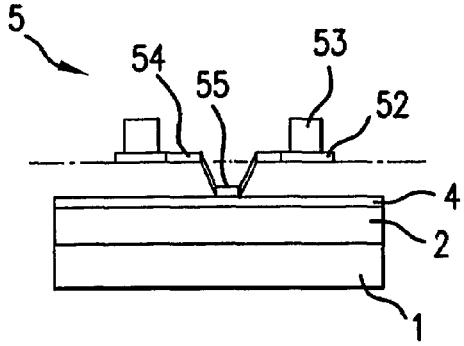

FIG. 9 illustrates a further embodiment of the present invention, and comprises bottom conductors 6 fabricated on a suitable substrate (2) covered with an optional dielectric material (4), an embedded coil (3), a cantilever (5) supported by torsion springs (54) with a single stage (55) on the substrate. The cantilever (5) has a bottom conducting layer (51), a thin structural material (52), and thick soft magnetic materials (53). A permanent magnet (3) provides a static magnetic field approximately perpendicular to the longitudinal axis of the cantilever. The cantilever can rotate about the torsion spring under external influences (e.g., magnetic fields). Since this new design has only one fixed stage on the substrate, the problem due to the CTE difference between the cantilever and the substrate is at least partially solved because the cantilever can freely expand on its free end during the thermal cycling. Also, the cantilever has two contact ends to counter balance the external actuation force and thus does not rely on the mechanical restoring force in the torsion springs (54) to counter balance the external actuation force. So the torsion spring can be designed to minimize the restoring force and maximize the contact force.

Figure 10A:
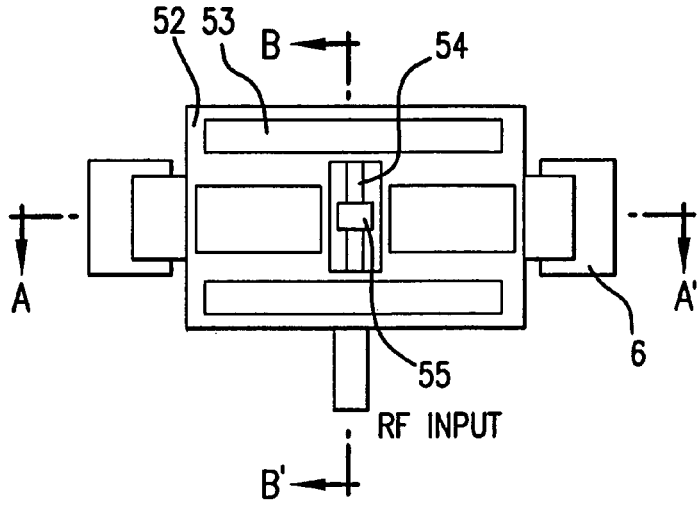
Figure 10B:
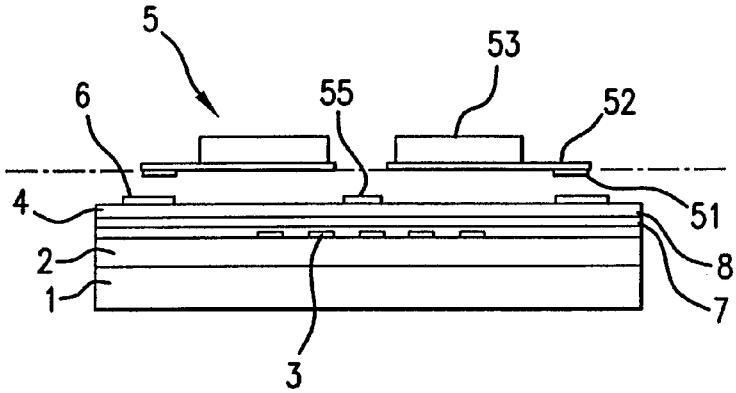
Figure 10C:
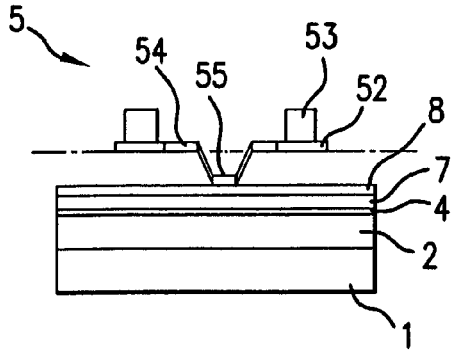

FIG. 10 illustrates a further embodiment of the present invention. The device comprises bottom conductors (6) fabricated on a suitable insulator (8) coated on a metal layer (7), a dielectric layer (4), an embedded coil (3), a cantilever (5) supported by springs (54) with a single stage (55) on the substrate (2). The cantilever (5) has a bottom conducting layer (51), a thin structural material (52), and thick soft magnetic materials (53). A permanent magnet (1) provides a static magnetic field approximately perpendicular to the longitudinal axis of the cantilever. The cantilever can rotate about the torsion spring under external influences (e.g., magnetic fields). The number of contacts is reduced as described above. Metal layer (7), which serves as a ground plane, shields the influence of the coil to the signal in the RF application. The signal travels from the input metal trace (not shown in the figure) to the stage (55), through spring (54), conductor (51) to the output pad (6). Conductor (51) can also be conformably extended or fabricated under the spring (54) and under the stage (55), as shown in FIG. 3.

Figure 11A:
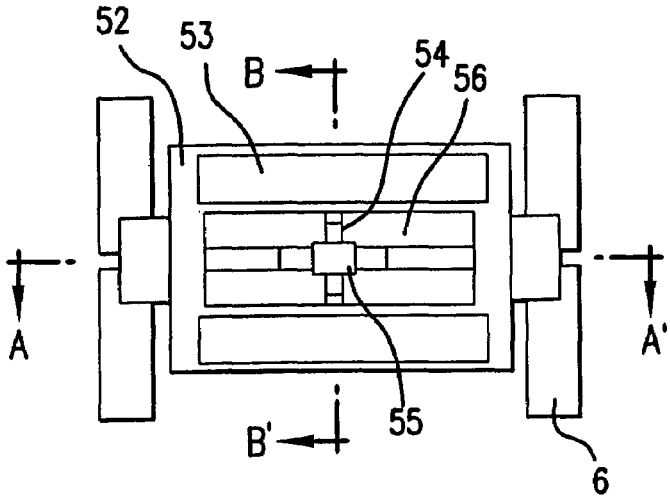
Figure 11B:
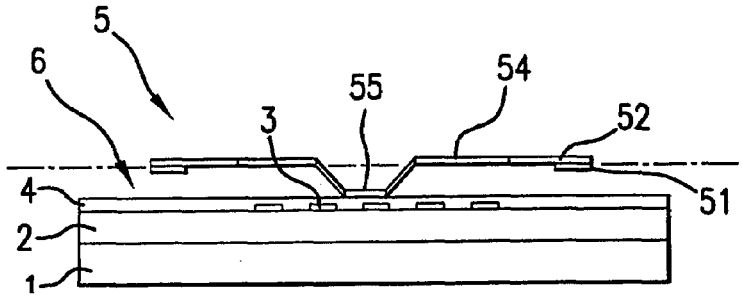
Figure 11C:
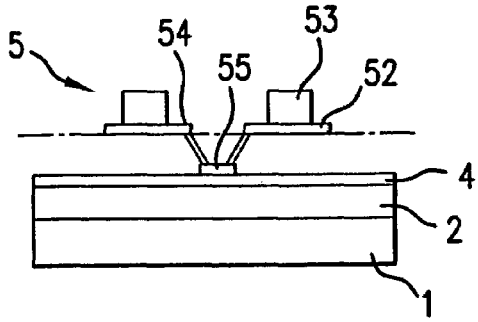

FIG. 11 illustrates an embodiment of the present invention with x-y springs (B-B' x-orientation: 54, and A-A' y-orientation: 56). In this case, the two springs can be made of different materials. For example, spring 54 can be made of a mechanically stronger material (e.g., Ni) to support the cantilever, while the spring 56 can be made of a more conductive material (e.g., Au) for electrical conduction.

Figure 12A:
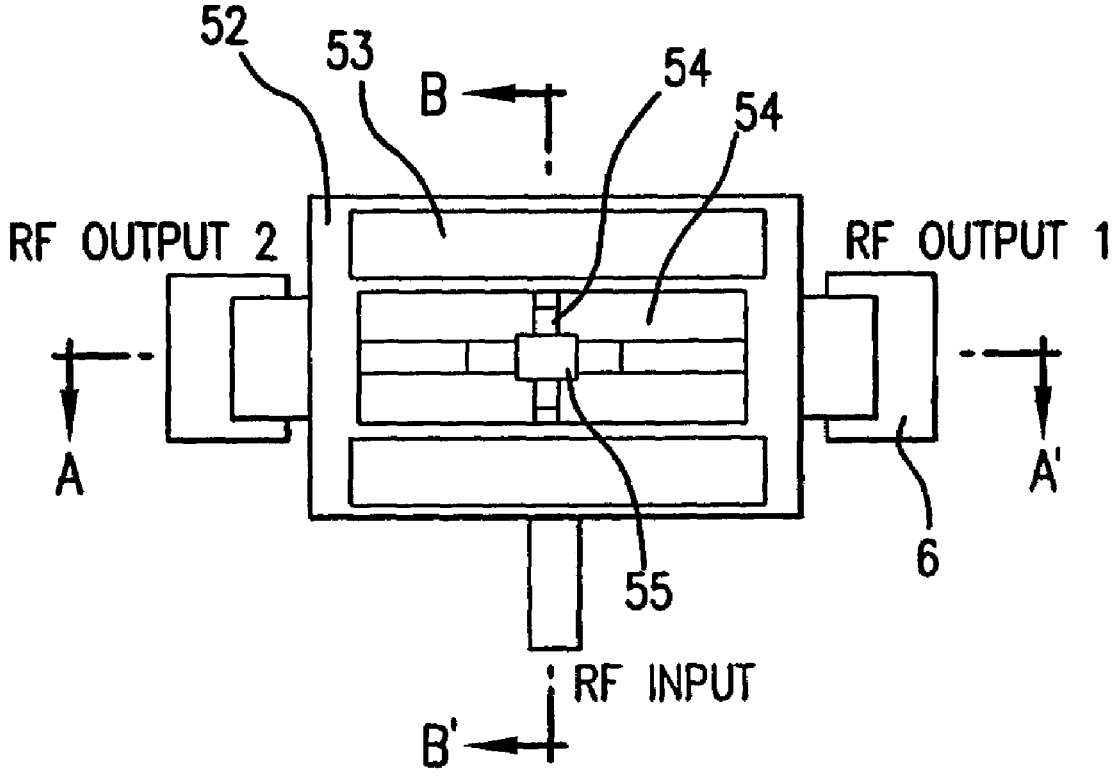
Figure 12B:
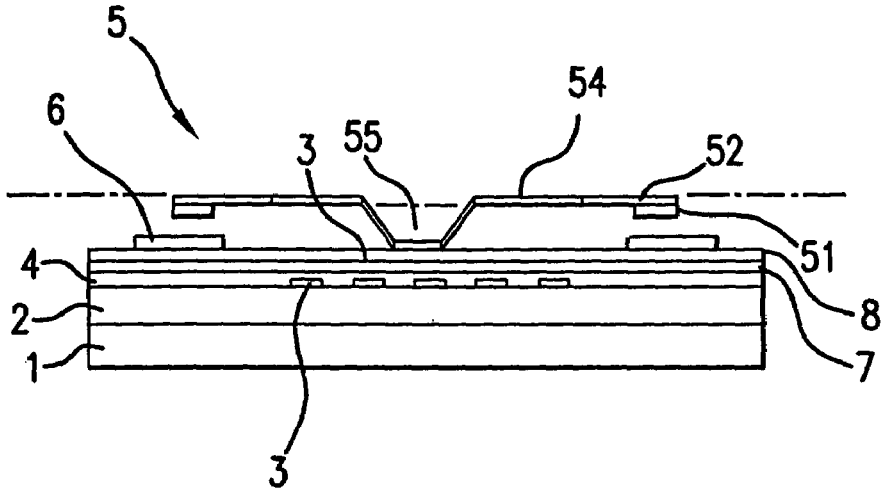
Figure 12C:
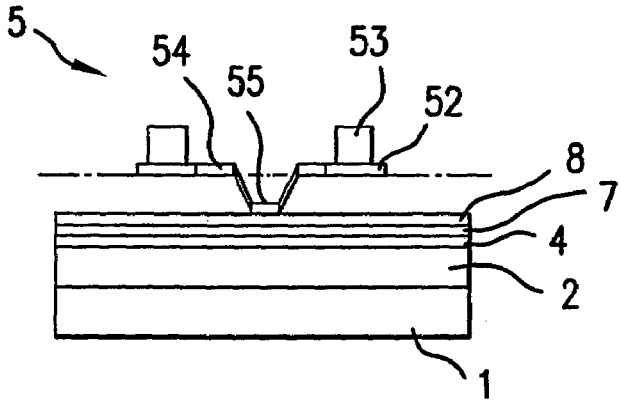

FIG. 12 illustrates a further embodiment of the present invention with x-y springs.

Figure 13:
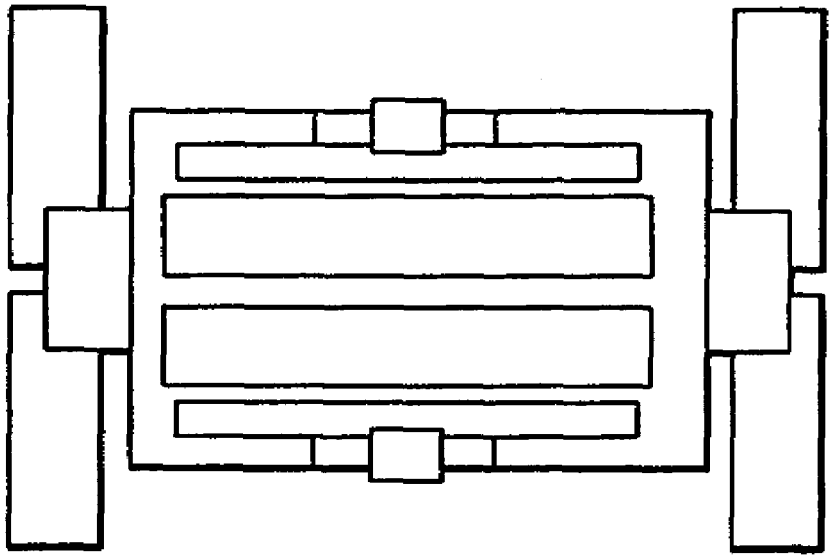

FIG. 13 illustrates an embodiment of the present invention with two stages. In this design, even though there are two stages on the two sides, the two ends of the cantilever are not fixed to the substrate and are allow to expand both in the x and y directions.

Figure 14:
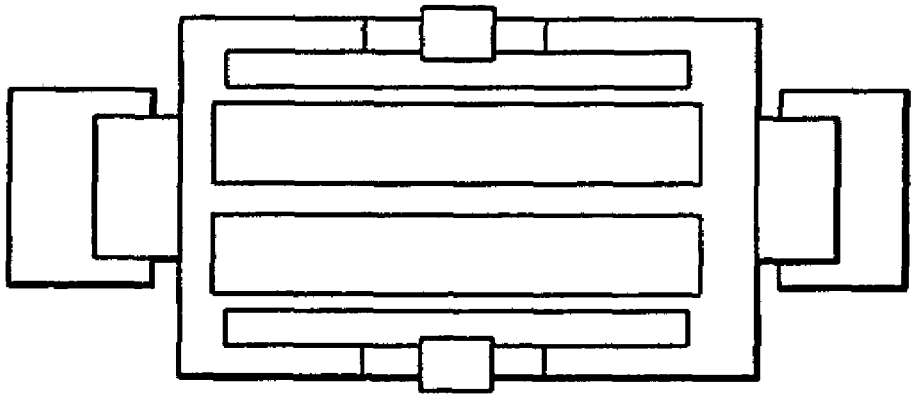

FIG. 14 illustrates a further embodiment of the present invention with two stages. In this design, even though there are two stages on the two sides, the two ends of the cantilever are not fixed to the substrate and are allow to expand both in the x and y directions.

CONCLUSION

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above. Finally, it should be emphasized that none of the elements or components described above are essential or critical to the practice of the invention, except as specifically noted herein.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What is claimed is:

1. A micro-magnetic switch comprising:

a permanent magnet;

a supporting device having contacts coupled thereto and an embedded coil, the supporting device being positioned proximate to the magnet;

a cantilever coupled to the supporting device at a location approximately at a central point of the cantilever, the cantilever having a conducting material coupled proximate an end and on a side of the cantilever facing the supporting device and having a soft magnetic material coupled thereto;

a metal layer coupled to the supporting device; and an insulating layer formed on the metal layer, wherein the central point of the cantilever is coupled to the insulating layer, wherein during thermal cycling the cantilever is configured to freely expand based on being coupled at a central point to the supporting device, which substantially reduces coefficient of thermal expansion differences between the cantilever and the supporting device.

2. The switch of claim 1, further comprising: a high permeability layer formed between the metal layer and the supporting device.

3. The switch of claim 1, wherein the contacts comprise first and second spaced input contacts and first and second spaced output contacts, such that the conducting material interacts with both contacts substantially simultaneously, which balances an external actuation force.

4. The switch of claim 1, wherein the cantilever comprises a spring between the central point and first and second end points.

5. The switch of claim 1, wherein the cantilever comprises two springs between the central point and each of first and second end points.

6. The switch of claim 1, wherein the cantilever is coupled via first and second spaced areas of the central point to the supporting structure.

7. A micro-magnetic switch comprising:

a permanent magnet;

a supporting device having contacts coupled thereto and an embedded coil, the supporting device being positioned proximate to the magnet;

a cantilever coupled to the supporting device at a location approximately at a central point of the cantilever, the cantilever having a conducting material coupled proximate an end and on a side of the cantilever facing the supporting device and having a soft magnetic material coupled thereto;

a metal layer coupled to the supporting device; and an insulating layer formed on the metal layer, wherein the central point of the cantilever is coupled to the insulating layer, wherein during thermal cycling the cantilever can freely expand based on being coupled at a central point to the supporting device, which substantially reduces coefficient of thermal expansion differences between the cantilever and the supporting device.

* * * * *

UNITED STATES PATENT AND TRADEMARK OFFICE

CERTIFICATE OF CORRECTION

PATENT NO. : 7,420,447 B2
APPLICATION NO. : 11/151663
DATED : September 2, 2008
INVENTOR(S) : Ruan et al.

It is certified that error appears in the above-identified patent and that said Letters Patent is hereby corrected as shown below:

On the title page, item [56]:

In the Foreign Patent Documents, please add:

| | |
|---|---|
| --DE 10031569 A1 | 02/01/2001 |
| DE 19820821 C1 | 12/16/1999 |
| EP 0452012 A2 & A3 | 10/16/1991 |
| EP 0685864 A1 | 12/06/1995 |
| EP 0709911 A2 & A3 | 05/11/1996 |
| EP 0780858 A1 | 06/25/1997 |
| EP 0869519 A1 | 10/07/1998 |
| EP 0887879 A1 | 06/19/1998 |
| EP 887879 A1 | 12/30/1998--. |

Column 2, line 23, please replace “on” with --one--.

Signed and Sealed this

Sixteenth Day of December, 2008

JON W. DUDAS
*Director of the United States Patent and Trademark Office*